US006354453B1

(12) United States Patent
Chasteen

(10) Patent No.: US 6,354,453 B1
(45) **Date of Patent: *Mar. 12, 2002**

(54) VENTED CONTAINER END APPARATUS AND METHOD

(75) Inventor: Howard Curtis Chasteen, Golden, CO (US)

(73) Assignee: Ball Corporation, Broomfield, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/467,644

(22) Filed: Dec. 20, 1999

Related U.S. Application Data

(63) Continuation-in-part of application No. 09/042,594, filed on Mar. 16, 1998, now Pat. No. 6,079,583.

(51) Int. Cl.[7] ..... B65D 17/34; B21D 51/44

(52) U.S. Cl. ..... 220/269; 220/271; 413/16; 413/17

(58) Field of Search ..... 220/269, 270, 220/271, 906; 413/15–17, 66, 67

(56) References Cited

U.S. PATENT DOCUMENTS

| | | | | | |
|---|---|---|---|---|---|
| 3,836,038 | A | * | 9/1974 | Cudzik | 220/269 |
| 4,024,981 | A | * | 5/1977 | Brown | 220/269 |
| 4,084,721 | A | * | 4/1978 | Perry | 220/269 |
| 4,901,880 | A | * | 2/1990 | Tatham et al. | 220/269 |
| 5,065,882 | A | * | 11/1991 | Sugiyama | 220/269 |
| 5,129,541 | A | * | 7/1992 | Voigt et al. | 220/269 |
| 5,655,678 | A | * | 8/1997 | Kobayashi | 220/269 |
| 6,079,583 | A | * | 6/2000 | Chasteen | 220/269 |

* cited by examiner

*Primary Examiner*—Nathan J. Newhouse
(74) *Attorney, Agent, or Firm*—Sheridan Ross P.C.

(57) ABSTRACT

A container end is provided so that upon opening, a generally triangular vent region is formed with an apex pointing rearwardly toward the head space to vent the container, e.g. during pouring. A container is provided that achieves a fast and smooth pour with a relatively small increase (relative to certain previous configurations) in the opening area and achieves a superior pour without increased bursting, buckling or opening failures associated with relatively larger openings.

11 Claims, 8 Drawing Sheets

VENTED CONTAINER END APPARATUS AND METHOD

The present application is a continuation-in-part of U.S. patent application Ser. No. 09/042,594, having a filing date of Mar. 16, 1998, now U.S. Pat. No. 6,079,583 and being incorporated herein in its entirety by reference.

The present invention relates to a container end which provides venting during emptying of contents and, in particular, a container with an end having a score defining a vent area providing good pouring characteristics without undue increase in the opening's size.

BACKGROUND INFORMATION

A number of containers are configured to achieve easy opening, such as without the need for a can opener or other tool and preferably which does not involve separation of any parts (so that there is no separate tab or cover piece to dispose of). A number of features of such containers and container ends affect the level to which end users, as well as bottlers, manufacturers, distributors, shippers and retailers, are satisfied with the container. One factor believed to be of some importance to consumers is the pour characteristics of the container. In general, it is believed that consumers prefer to use containers capable of providing a relatively high pour rate, such as pouring about 350 ml in less than about 10 seconds, preferably less than about 8 seconds, and more preferably less than about 7 seconds (e.g., measured using pour rate testing as described below). Additionally, it is believed consumers prefer containers that provide a smooth or substantially laminar pour, i.e. a pour which is not characterized by a series of surges (which can cause splashing and/or can affect a beverage head, fizz or other carbonation or pressurization-related characteristics of the contents, after pouring).

Certain previous containers have been configured in an attempt to address these concerns by providing relatively large openings, e.g. openings covering greater than about 0.5 square inches (about 3.2 $cm^2$). Unfortunately, such larger openings tend to be associated with a higher rate of problems such as bursting, buckling, leakage, opening failures and the like, particularly when the contents are pressurized, such as being provided with an over-pressure of about 35 psi (about 250 kPa) or more. In some cases, large opening panels are provided in designs having relatively smaller hinge or "gate" regions, which can, in some instances, be associated with container leakage and/or separation of the panel, or other components, upon opening, sometimes causing parts to be expelled ("missileing"). Furthermore, such larger openings are difficult or infeasible to provide in container ends which are relatively small, such as round container ends having a diameter of than about 2 inches (about 5 cm). Furthermore, certain previous approaches to improving pouring characteristics have involved major changes to the design of the container end, thus involving relatively high tooling or other equipment costs, design costs, testing costs and the like.

Accordingly, it would be useful to provide a container or container end with improved pouring characteristics while retaining a relatively small opening area, which is preferably compatible with relatively small-sized container ends, and which can be achieved with only modest changes in tooling, procedures and/or testing.

SUMMARY OF THE INVENTION

The present invention relates to a container and container end of a type where an opening area is at least partially defined by a score line. First and second endpoints of the score line are spaced apart along the score line, and the opening area is bent inward, following rupture (e.g. via a tab pivoted about a rivet, along an opening axis). The pivot point defined by the rivet is generally at about the center or centroid of the container end. The spaced-apart ends of the rupture define an opening or "gate" axis about which the bent-in region bends or pivots. The present invention involves configuring the score line so that the area which is bent-in provides an opening which defines not only a pouring region but also a vent region. In one embodiment the vent region is shaped (substantially triangular) with an edge of the vent region defined by the gate region. The vent region has an apex pointing generally away from the pour area. In one embodiment, both termination points at the rupture line are located on the same side of the opening axis but on opposite sides of a pivot axis (which is perpendicular to the opening axis and substantially passes through the pivot point of the tab). Preferably a first end of the rupture line extends substantially from a region adjacent a pivot point to the apex of the triangular vent region, forming one side of the triangular vent region. The gate axis, forming a second side of the triangular vent region, extends from this rupture line termination point to the other rupture line termination point. Preferably at least a portion of the end initially covering the vent region is reinforced with a stiffening shape, preferably triangular in shape, and preferably having an edge of the stiffening shape generally adjacent or colinear with the gate defined between the two rupture line end points. The present invention provides a desirably fast, smooth pour while maintaining a relatively small total opening area (pour opening plus vent opening) and otherwise avoiding undesirable bursting, buckling and opening failures.

DETAILED DESCRIPTION OF THE PREFERRED EMBODIMENTS

Figure 1:
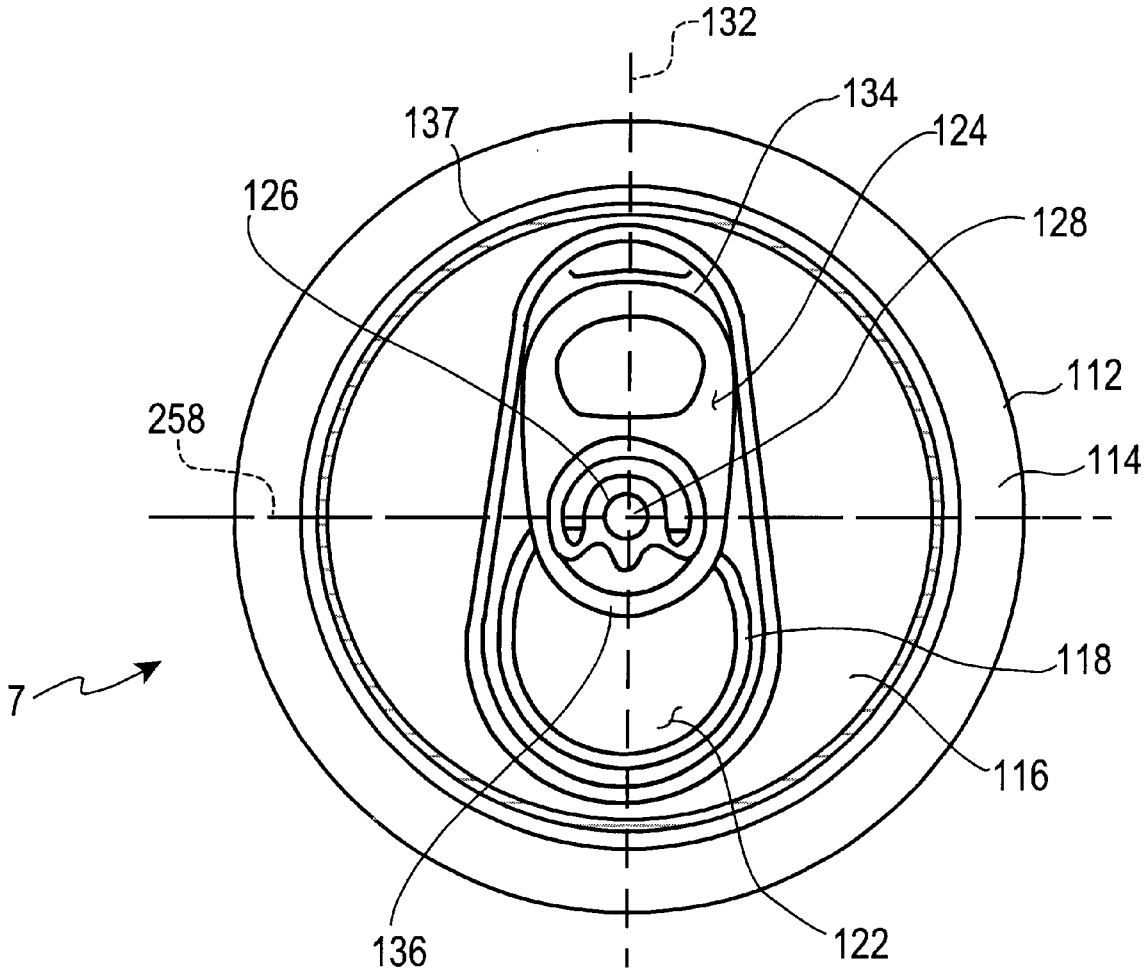
FIG. 1 Prior Art
FIG. 1 is a top plan view of a container according to previous devices.

Although the present invention can be used in connection with a number of container configurations, one particular prior container configuration is shown, in top view, in FIG. 1. In the container of FIG. 1, a container body 112 is provided with a necked region 114 leading to a body end which is covered, in the depicted embodiment, with a container end 116. Manners of forming container bodies and container ends and of attaching or coupling the two, to form the depicted device, are well known in the art.

The container end 116 includes a score line 118 (described more thoroughly below) commonly formed by stamping with a die or "knife" to define an opening area 122. A tab 124 is coupled to the can end 116 e.g. by a rivet 126 whose center 128 defines a pivot point 132. Generally, pulling the upper edge 134 of the tab 124 up and towards the opening region 122, (defining an opening axis 132) results in the forward edge 136 of the tab 124 pressing downward (e.g. with respect to the rivet) on part of the opening area 122 with sufficient force to cause a rupture to form along the score line 118, permitting the opening area 122 to bend or pivot inward about a gate axis (described below). Once the opening region 122 of the top 116 has been thus pivoted inward, the can end 116 has an opening whose perimeter is defined by the score line 118 and the gate axis.

Figure 2:
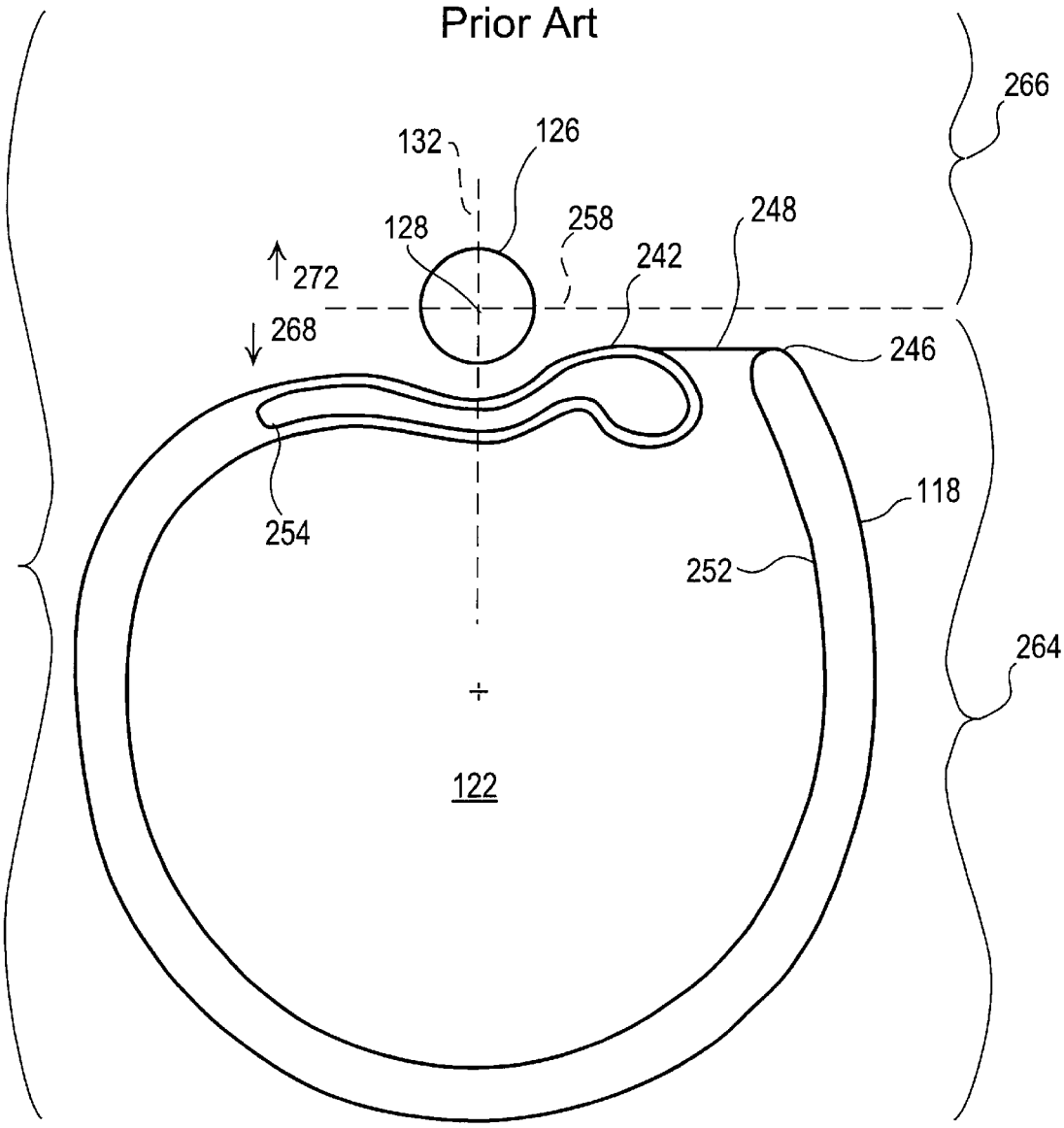
FIG. 2 Prior Art
FIG. 2 is a top plan view of a score and tab rivet region according to previous devices.

As seen in FIG. 2 (depicting a configuration without a tab 124 in place, for better illustration), the score 118 along which the rupture occurs has first and second rupture end points 242, 246 and the imaginary line 248 connecting the rupture end points defines the gate axis about which the opening region 122 of the can end bends or pivots inward to form the opening. In the depicted configuration, a second inward "anti-fractive" score line 252 is positioned substantially parallel with the rupture score line 118. The interior score line 252 has been found useful in protecting the rupture score line 118, although no rupture occurs along the interior score line 252 in normal operation. In the configuration depicted in FIG. 2, a clearance element 254 is positioned between the outer and inner score lines in a region near the tab rivet 126.

Several characteristics of the previous configuration shown in FIG. 2 are useful to note in connection with explaining the present invention described below. The total open area after the opening region 122 is bent inward is defined by the score line 118 plus the gate axis 248 and, in at least some previous devices, this opening region had an area of about 0.45 to 0.47 square inches (about 2.9 to about 3.0 $cm^2$). In the configuration depicted in FIG. 2, the gate axis 248 is substantially parallel to a second or pivot axis 258 which is perpendicular to the opening axis 132 passing through the pivot point 128.

For purposes scription, the portion of the can top lying on one side of the second axis 258 (which, in FIG. 2, contains the opening region 122) will be referred to, in the following, as the forward region 264, and the portion on the opposite side of the second axis 258 will be referred to as the rearward portion 266, thus defining a forward direction 268 and a rearward direction 272, both generally parallel to the opening axis 132.

Figure 8:
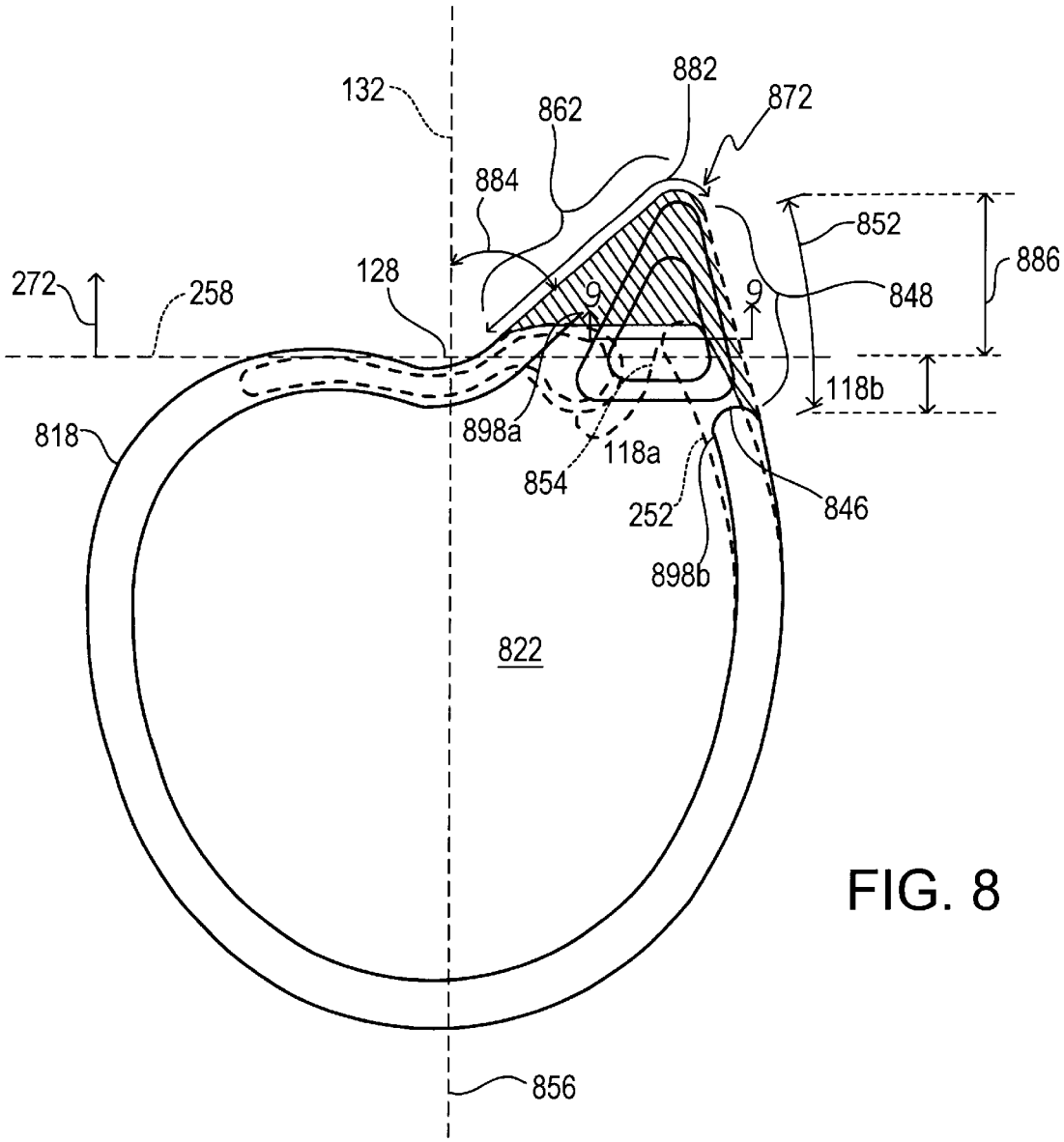
FIG. 8 is a top plan view showing an opening region according to an embodiment of the present invention, compared to previous devices.

FIG. 8 illustrates a configuration of a score line according to an embodiment of the present invention and depicts how it differs from the previous score line, generally as illustrated in FIG. 2. In FIG. 8, the previous score line 118*a,b* and previous anti-fracture score 252 are shown in phantom for comparison purposes. In the embodiment of FIG. 8, the score line 818 provides first and second rupture endpoints 842, 846 positioned to define a generally triangular vent region 862. The line 848 between the rupture end points 842, 846 defines the gate axis for the embodiment of FIG. 8 along which the opening region 822 bends or pivots following rupture along the rupture score line 818.

In the embodiment of FIG. 8, the first end point 842 defines an apex 872 of the triangular region 862 with the triangular region pointing rearwardly 272 (with respect to the second axis 258. The gate region 848 is, in the depicted embodiment non-parallel to the second axis 258. The portion 882 of the rupture line 818 which substantially defines a second side of the triangular region 862 is also substantially non-parallel to the second axis 258 and forms an acute angle 884 with respect to the opening axis 132 (measured in a direction from the opening axis 132 toward the second axis 258) with the angle 884 being approximately 45° to about 60°. The second end point 846 and first end point 842 are positioned on opposite sides of the second axis 258 with the second end point 846 being on the same side of the second axis 258 as the major portion of the opening area 822.

Thus, during pouring, the triangular region 862 will generally point towards (and provide venting to) the head space of the container (i.e. the portion above the contents being poured). In the depicted embodiment both the first endpoint 842 and the second end point 846 lie on the same side (in the orientation and configuration depicted in FIG. 8, the right side) of the opening axis 132. The front-rear distance (i.e. a distance generally parallel to the opening axis 132) of the first end point 842 from the second axis 258 is greater than the front-rear distance of the second end point 846 from the second axis 258. The first end point 842 is also farther from the pivot point 128 than the second rupture end point 846. Although positioning the apex 872 as far rearward as possible is believed to, in general, facilitate venting, it is believed that positioning significantly more rearwardly than described and depicted herein may lead to undesired upward displacement of the rivet region and/or opening failure. Preferably the distance 884 is between about 0.1 inches (about 2.5 mm) and about 0.5 inches (about 1.2 cm). In the one embodiment, the distance 886 is about 0.3 inches (about 0.8 mm). In one embodiment, the configuration depicted in FIG. 8 is provided in a container end with a generally circular perimeter (as described in FIG. 1) and preferably attached to a container generally as depicted in FIG. 1. In this configuration, the first end point 842 is closer to the perimeter of the container end 137 (FIG. 1) than the second rupture end point 846. The total area of the opening after removal of the opening region 822 in the embodiment of FIG. 8 is only slightly larger than the area of the opening of the resulting from the configuration of FIG. 2 and is preferably less than about 0.7 square inches (about 4.5 $cm^2$), more preferably less than about 0.6 square inches (3.8 $cm^2$), even more preferably less than about 0.5 square inches (about 3.3 $cm^2$), such as being about 0.4923 square inches (about 3.176 $cm^2$).

Figure 9:
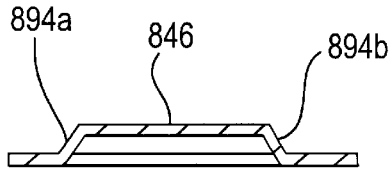
FIG. 9 is a cross-sectional view taken along line 9—9 of FIG. 8.

Preferably, a reinforcing or stiffening structure 892 is provided for adding stiffness to the triangular and/or gate or hinge area, helping it to open completely and helping to prevent a tear across the vent area during opening. Although stiffening in this region can take a number of forms, in the depicted embodiment, the stiffening region has a generally triangular shape, with one edge of the triangle being substantially adjacent to the gate or hinge area 848. Preferably the stiffening or reinforcing area 892 has a size and a shape (e.g. as depicted in FIG. 8) such that the location of the region of contact between the tab and the opening area 822 traces or defines a path 854 which intersects or lies at least partially within the stiffening region 892. Preferably edges or walls of the stiffening region 892 are positioned substantially adjacent one or both of the rupture score ends 842, 846 and assist in avoiding propagation of the rupture beyond the rupture score end points 842, 846. In the depicted embodiment, the stiffening region 892 is substantially adjacent the ends 898*a,b* of the anti-fracture scores which assist in avoiding any rupture propagating from the anti-fracture scores. In the depicted embodiment, the stiffening region 892 has a cross-sectional configuration as depicted in FIG. 9. As shown in FIG. 9, the stiffening area 892 provides inner and outer ramped or sloped surfaces 894*a,b* and a central flat region 896. In the embodiment of FIG. 8, the positioning of the hinge region 848 facilitates provision of a relatively long hinge such as having a length 852 of about 0.1 inches (about 0.25 cm). Providing a relatively long hinge 852 is believed useful in avoiding the opening region 822 becoming completely detached from the container top (and potentially presenting a risk of swallowing).

The present configuration, by providing for enhanced pourability without unduly increasing the size of the opening area can assist in avoiding premature or explosive openings or venting, such as might occur when the contents of the container, relative to the outside ambient atmosphere, is under relatively high pressure such as about 70–90 psi (e.g. as might occur if the contents have been heated or subjected to a low-pressure atmosphere, such as in an aircraft). In at least the configuration of FIG. 8, the hinge area 848 is positioned and configured in such a way that the opening area 822 can be bent or folded down into the interior of the container as desired substantially without buckling or other distortions or folds positioned or extending away from the hinge axis 848.

In one embodiment the opening score 818 is configured to provide a rupture propagation pattern in such a fashion that the rupture (which typically begins near the opening axis 132, propagates to the first rupture point 842 before it propagates to the second rupture point 846. Preferably, the rupture propagates to the first rupture point 842 substantially before the rupture propagates to the lower most point 856 of the rupture score (where the opening axis 132 intersects the rupture score 818 farthest away from the initial rupture region). If desired, the rupture score can be provided with a linearly varying depth to advance or retain rupture propagation in order to achieve the rupture timing as described.

Figure 10:
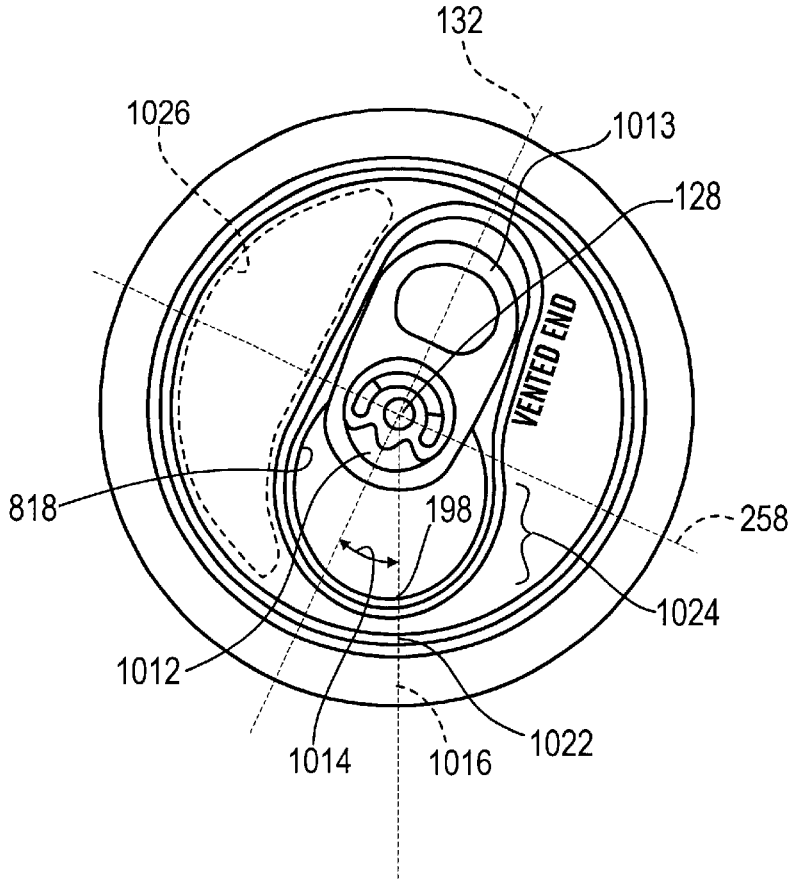
FIG. 10 is a top plan view of a container showing an end according to an embodiment of the present invention.
Figure 11:
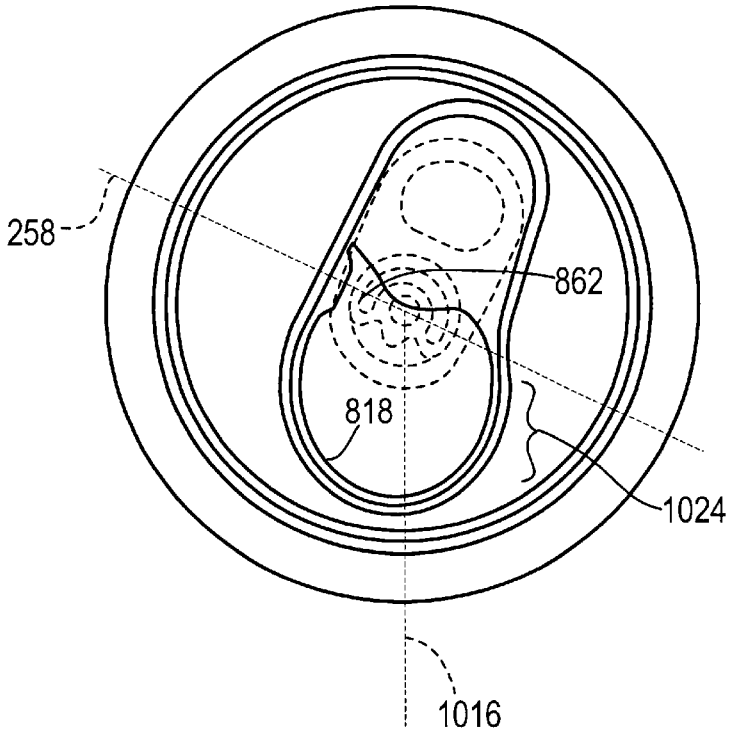
FIG. 11 is a top plan view of a container corresponding to FIG. 10, after opening, with the tab shown in phantom.

FIGS. 10 and 11 depict an embodiment in which the can end is not symmetrical about the opening axis. In the embodiment of FIGS. 10 and 11, the opening axis 132 which passes through the pivot point 128 and the tab initial contact point 1012 (and typically passes through the longitudinal axis or center line of the tab 1013) is positioned at an angle 1014 (such as between about 10° and about 30°, preferably about 24°) with respect to a third axis 1016 passing through the pivot point 128 and the central point 1018 of the portion of the rupture score 818 which lies to the perimetef the container end 1022. As can be seen from FIGS. 10 and 11, the third axis 1016 is substantially an axis of symmetry of the forward half 1024 of the rupture score 818 or opening.

A number of benefits are believed to arise from off-setting the opening axis (and the tab axis) from the (forward) opening symmetry axis 1016. As seen in FIG. 11, the second axis 258 passes through a more rearward portion of the triangular region 862, compared to the configuration of FIG. 8. Providing for the tab working on substantially the same like or plane as the triangular vent is believed to enhance opening characteristics. The off-set configuration of FIGS. 10 and 11 are believed to reduce the amount by which the pivot point 128 or rivet of the tab 1013 is lifted during opening (with respect to the surface of the can end) which is believed to provide more favorable leverage (avoiding excessive movement of the fulcrum or pivot point) and thus making initial rupture and initial propagation easier. In a more symmetric orientation such as that depicted in FIG. 8, substantially equal areas are defined on either side of the tab/opening region for accommodating indica such as advertising, identification, promotions and the like. The off-set configuration of FIGS. 10 and 11 provides such an area 1026 on one side of the end 1026 which is substantially larger than the area available in previous configurations (albeit at the cost of reduction of available area on the opposite side of the container end). Although benefits of providing an off-set configuration can be achieved using a number of different off-set angles 1014, it is believed that using a particular and preferably recognizable angle 1014 can serve as an indicator or marker of the characteristics or source of the container and can present a distinctive and decorative appearance.

Figure 3:
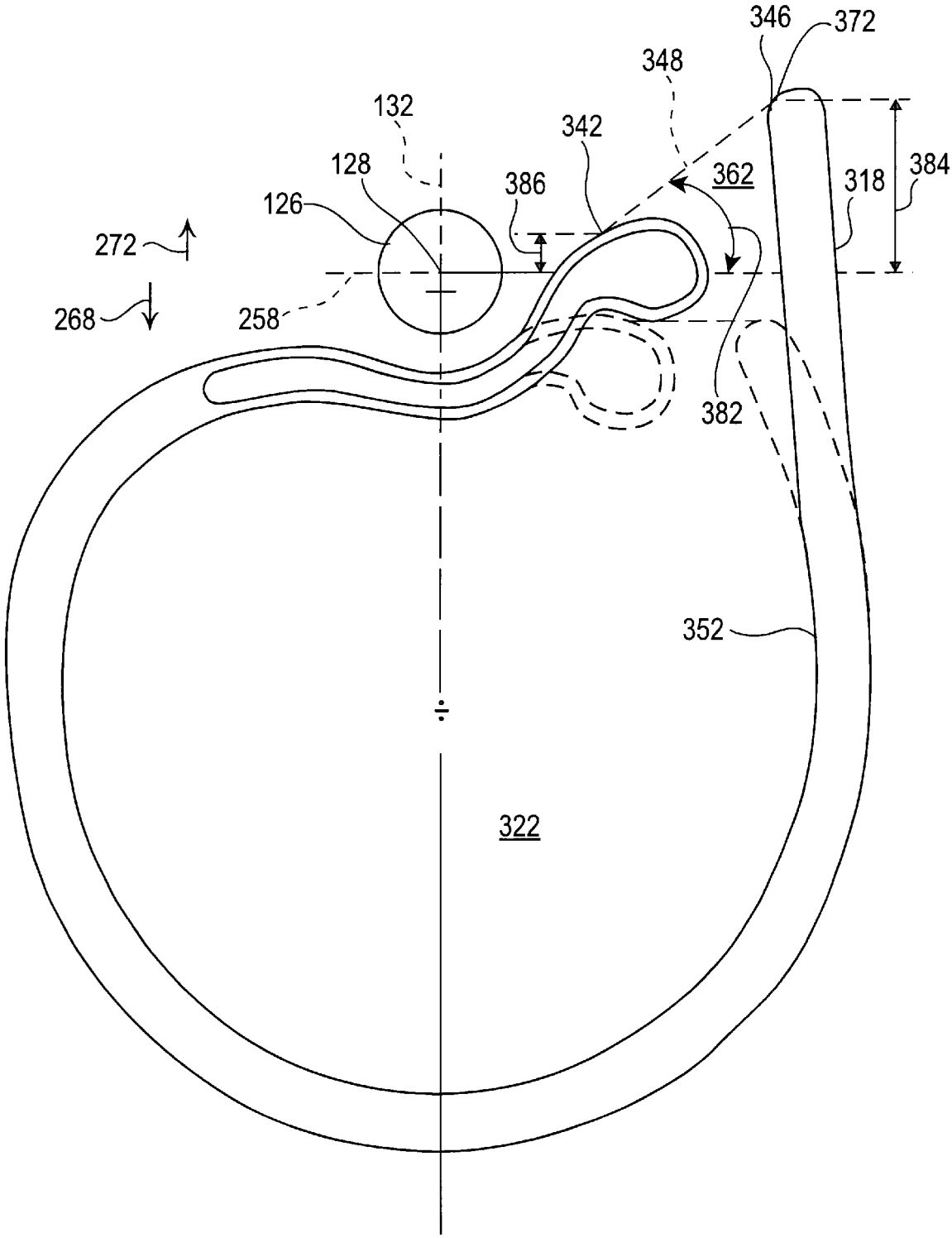
FIG. 3 is a top plan view of a score and tab rivet region.

FIG. 3 illustrates a configuration of a score line according to another embodiment of the present invention and depicts how it differs from the previous score line of FIG. 2 (shown in phantom lines in FIG. 3). In the embodiment of FIG. 3, the score line 318 provides first and second rupture end points 342, 346 positioned to define a generally triangular vent region 362. The line 348 between the rupture end points 342, 346 defines the gate axis for the embodiment of FIG. 3, along which the opening region 322 bends or pivots following rupture along the rupture score line 318.

In the embodiment of FIG. 3, the second end point 346 defines an apex 372 of the triangular vent region 362. As shown, the apex 372 of the triangular region 362 points rearwardly 272 (with respect to the second axis 258). The gate region 348 is non-parallel to the second axis 258 and forms an angle 382 therewith (measured in a direction from the second axis 258 toward the gate axis 348 and generally in a direction toward the pivot point 128) which is less than 90° preferably about 45°. The configuration with the gate axis (considered in a direction towards the apex) angled away from the opening axis 132 is believed to provide good pour characteristics without unduly affecting opening characteristics. The second end point 346 (and, preferably, the first end point 342, as well) is positioned on the opposite side of the second axis 258 from the major portion of the opening area 322, i.e. is positioned rearward 272 of the pivot point 128.

Thus, during pouring, the triangular region 362 will generally point towards (and provide venting to) the headspace of the container (i.e. the portion above the contents being poured). In the depicted embodiment both the first end point 342 and the second end point 346 lie on the same side (in the orientation and configuration depicted in FIG. 3, the right side) of the opening axis 132. The front-rear distance (i.e. a distance generally parallel to the opening axis 32) of the second end point 384 from the second axis 258 is greater than the front-rear distance 386 of the first end point 342 from the second axis 258. The second end point 346 is also farther from the pivot point 128 than the first rupture end point 342. Although positioning the apex 372 as far rearward as possible is believed to, in general, facilitate venting, it is believed that positioning significantly more rearwardly than described and depicted herein may lead to undesired upward displacement of the rivet region and/or opening failure. Preferably the distance 384 is between about 0.1 inches (about 2.5 mm) and about 0.5 inches (about 1.2 cm). In one embodiment, distance 384 is about 0.3 inches (about 8 mm).

In one embodiment, the configuration depicted in FIG. 3 is provided in a container end with a generally circular perimeter as depicted in FIG. 1 and preferably attached to a container generally as depicted in FIG. 1. In this configuration, the second end point 372 is closer to the perimeter of the container end 137 (FIG. 1) than the first rupture end point 342.

Figure 4:
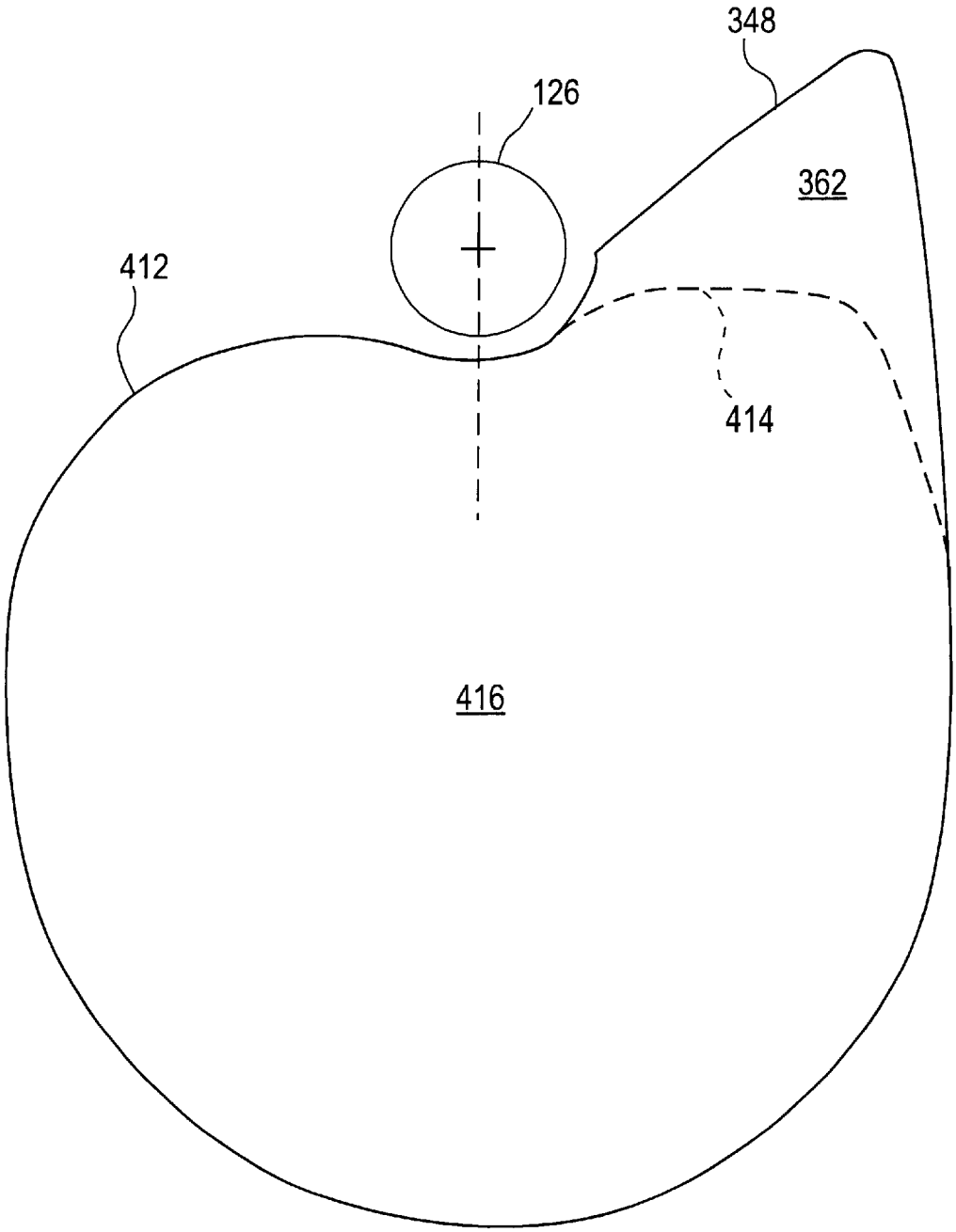
FIG. 4 is a top plan view similar to that of FIG. 3 but showing the opening region compared to that of previous devices.

FIG. 4 depicts outline of the opening 412 resulting after the opening region 372 has been bent inward about the gate axis 348. The contour or perimeter of an opening according to previous devices (such as that depicted in FIG. 2) is shown, in FIG. 4, in phantom lines 414 illustrating how it differs from a score line contour 412 according to the present invention. The total area of the opening 416 in the embodiment depicted in FIG. 4 is only slightly larger than the area of the opening resulting from the configuration of FIG. 2 and is preferably less than 0.7 square inches (about 4.5 $cm^2$), more preferably less than 0.6 square inches (3.8 $cm^2$), even more preferably less than about 0.5 square inches (about 3.2 $cm^2$, such as being about 0.4892 square inches (about 3.156 $cm^2$).

Figure 5:
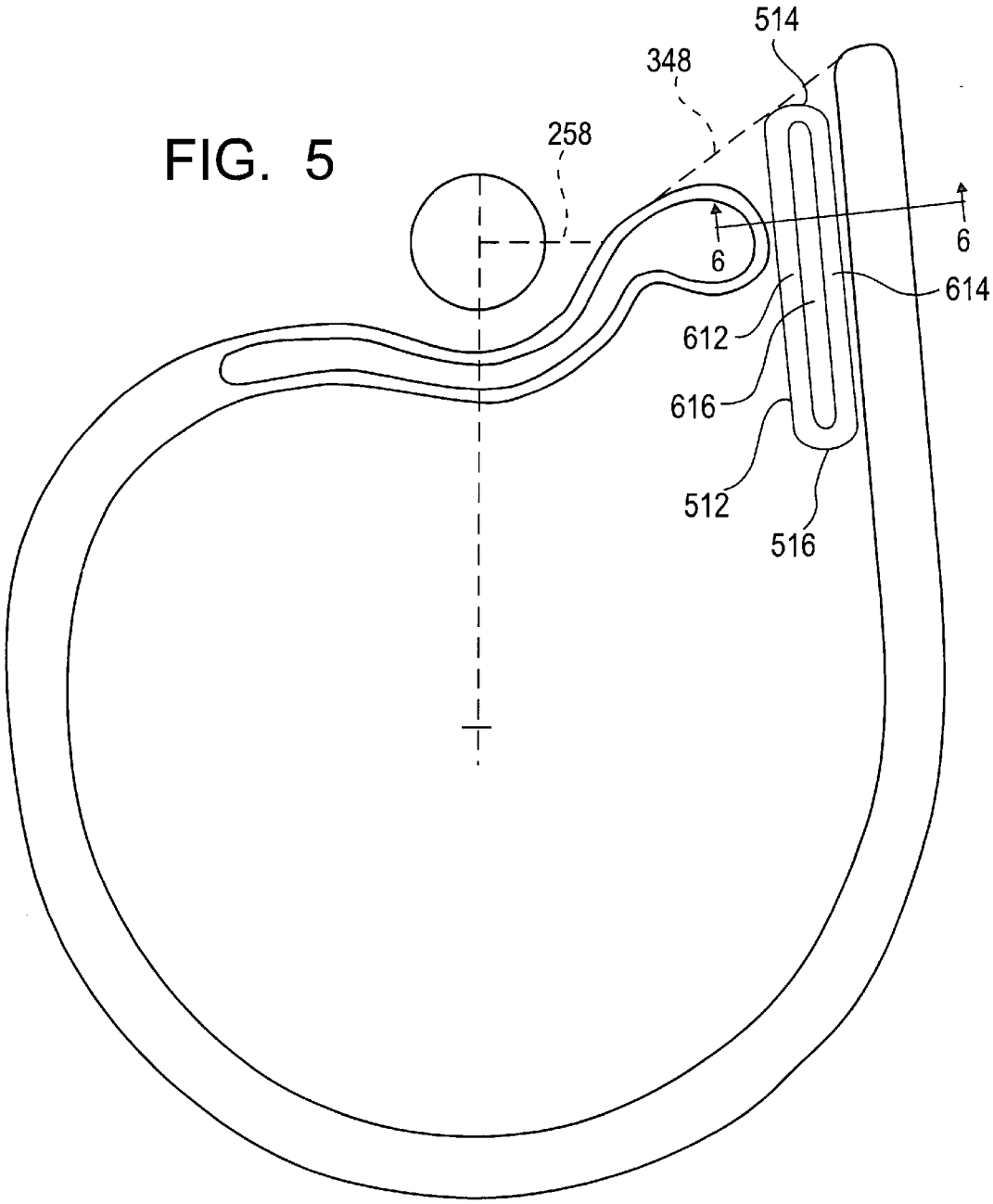
FIG. 5 is a top plan view similar to the view of FIG. 3 but showing inclusion of a reinforcing bead.
Figure 6:
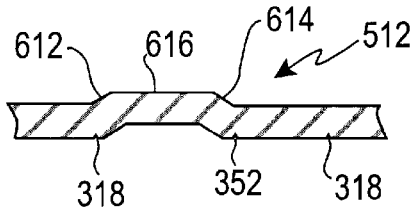
FIG. 6 is a cross-sectional view taken along line 6—6 of FIG. 5.

FIG. 5 shows an embodiment similar to the embodiment of FIG. 3 but with a reinforcing bead 512 provided for adding stiffness to the hinge area, helping it to open completely and helping to prevent a tear across the vent area during opening. Although stiffening in this region can take a number of forms, in the depicted embodiment the bead 512 extends from a first end 514 substantially adjacent the gate axis 348 and extending forward, across the second axis 258 to a second end 516. In the depicted embodiment, the bead 512 has a cross-sectional configuration as depicted in FIG. 6. As shown in FIG. 6, the bead 512 provides inner and outer ramped or sloped surfaces 612, 614 and a central flat region 616. The cross-sectional view of FIG. 6 also shows the location of score line 318 and inner score line 352.

In practice, a can end is formed by providing a generally flat blank according to procedures well known in the art. A die is used to stamp the can end providing a score line configured as depicted in FIGS. 8 and 3–6 and, preferably, other features such as reinforcing beads or other reinforcements and the like. A tab is coupled to the can end generally as provided in previous procedures well known to those of skill in the art. A can end thus formed is coupled to a container body, formed according to procedures known to those of skill in the art, to provide a completed and preferably filled container.

In one embodiment, producing container ends in the manner and form described can be achieved using materials and apparatus generally similar to that used in previous procedures for forming container ends such as those depicted in FIG. 2, but using a die or other scoring device configured to provide the score (and, preferably, reinforcing or other features) as depicted in FIGS. 8 and 3–6. In this way, it is possible to implement the present invention with few changes to previous procedures and apparatus thus minimizing or reducing costs associated with retooling, procedural changes, testing and the like. Of course, if desired, it is possible to use the present invention in connection with different container or container end designs.

In use, a user will gain access to the contents of a container formed according to the present invention in a manner somewhat similar to that used in connection with previous designs, namely by grasping the rear edge of a tab and pulling it forward pivoting along the opening axis causing rupture along the rupture score and bending the opening region inwardly about the gate axis to form an opening which includes both a pour area and a vent area. Preferably the forwardmost regions of the score line are the first to rupture, and the portions defining the vent region are the last to rupture. The user will then tip the container (FIG. 7) causing the container contents to exit through the pour area of the opening under the influence of gravity while air can enter through the vent region to achieve a smooth and rapid pour. In one embodiment of the present invention, a smooth pour will be achieved at a pour rate of 350 ml in less than about 10 seconds, more preferably in less than about 8 seconds and even more preferably less than about 7 seconds, such as in about 6.8 seconds.

According to one pour testing procedure, aluminum alloy 12-oz. cans with ends generally as depicted in the figures, (of the type similar to that currently commonly used for 12-oz. beverage containers, and available from Ball Corporation under the designation 202B-64) were filled with approximately 350 ml of tap water at approximately standard temperature and pressure. Samples were held by the bottom dome of the can with a vacuum chuck. Samples were pivoted about the can's center to a positive stop at 55° from vertical whereupon a timer was started. When the fluid flow diminished sufficiently that the smooth (laminar) flow turned rough (non-laminar) the timer was stopped. Each sample was tested 10 times and an average was taken. Times for any sample were found to vary by less than about $^{3}/_{10_{ths}}$ of a second. When the procedure was used for containers according to previous configurations (e.g. as depicted in FIG. 1) the average time according to the above-described procedure was 9.98 seconds (about 38 ml per second). When the procedure was used in connection with a can formed according to the present invention (e.g. as depicted in FIGS. 3 and 4) pour rates were greater than 40 ml per second, and even exceeded 50 ml per second, with the average time being 6.8 seconds (about 51.5 ml per second).

Figure 7:
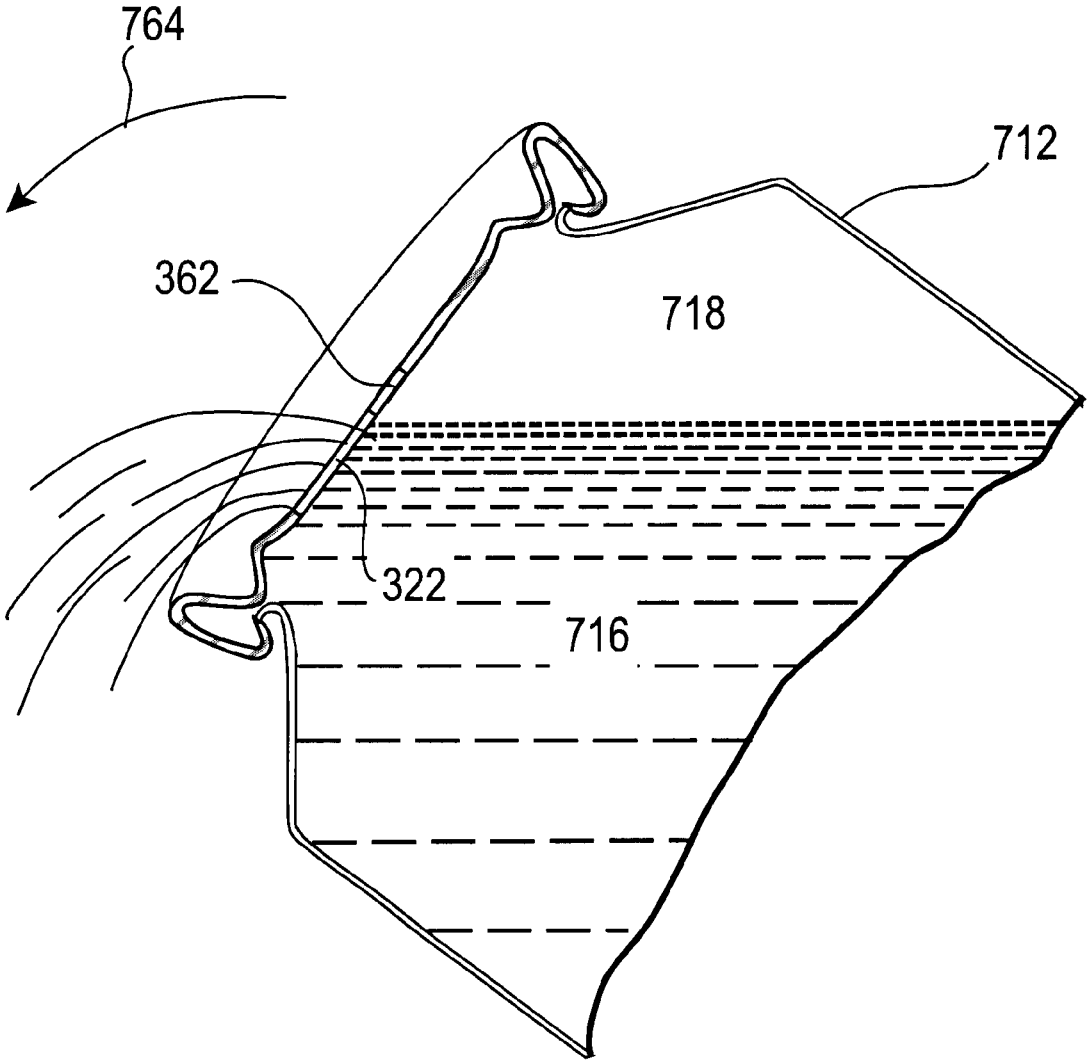
FIG. 7 is an elevational view, partly in cross-section, showing pouring contents of a container, according to an embodiment of the present invention.

As shown in FIG. 7, when the container 712 is tipped in a tip direction 714 substantially along a tip axis parallel to the opening axis 132 (which lies in the plane of FIG. 7 or parallel thereto), contents of the container 716 pour through the pour opening 822, 322 while the container head space 718 is vented through the vent opening 862, 362 to achieve a smooth and rapid pour.

In light of the above description, a number of advantages of the present invention can be seen. The present invention provides a container which produces a smooth pour and a relatively rapid pour while avoiding certain disadvantages associated with previous approaches, such as disadvantageous bursting, buckling, leaking or opening failure. The present invention is feasible in the context of relatively small-diameter tops such as tops with a diameter less than about 2 inches (about 5 cm). The present invention thus achieves a relatively small, efficient opening that results in a quick and smooth pour without the ill effects associated with a large opening. The present invention provides a unitary pour-vent opening with the preferably triangular vent region having an apex pointing rearward toward the head space to allow smooth entry of air to vent the container. The present invention achieves venting without requiring the production of two separate openings, without requiring the user to rotate or otherwise move the tab away from the position used for forming the pour opening, or to re-flex the tab and in which the opening is configured to achieve a tipping pour direction which is essentially along the opening axis. The present invention configures a gate or hinge axis on an angle (e.g. with respect to the second axis 258) creating an apex or point 372 which allows air to easily enter the container during pouring. The present invention achieves these benefits while making only a small increase in the size of the opening (compared to previous devices) such as an increase of about 0.0382 square inches (about 0.246 $cm^2$), compared to depicted previous configurations.

A number of variations and modifications of the present invention can be used. Although the invention has been described in the context of an opening for a container end coupled to a conventionally formed and shaped container, the present invention can also be used in connection with a wide variety of other containers or container ends by providing an opening with a triangular vent region pointing rearwardly and generally away from the tab pivot point. The present invention has been described in connection with a container for a pressurized liquid but can be used in connection with containers containing other items such as non-pressurized liquid. Although the present invention has been described in the context of a container formed of conventional materials (such as an aluminum container), a container according to the present invention can be formed of other materials including other metals or metal alloys, plastics, cardboard, paper, fiber reinforced materials, and the like. It is possible to use some features of the invention without using other features, such as providing a score line configured to produce a rearwardly pointing vent area without using the described and depicted reinforcing bead. Although certain shapes for a stiffening region have been depicted, other shapes and types of reinforcing can be provided such as relatively thickened or corrugated regions or regions with other materials included or added such as with a reinforcing plate coupled thereto. It is possible to provide a mirror image configuration, if desired. Although embodiments of the present invention were described as being especially useful in connection with containers having end diameters of about 2⅛ inches or less, the present invention can also be used on containers having end diameters greater than 2⅛ inches.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g. for improving performance, achieving ease and/or reducing cost of implementation. The present invention includes items which are novel, and terminology adapted from previous and/or analogous technologies, for convenience in describing novel items or processes, do not necessarily retain all aspects of conventional usage of such terminology.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A ventable end for use with a container comprising:

a generally flat cover region with a score defining first and second rupture endpoints, wherein at least a portion of said score extending between said first and second rupture endpoints together with a gate axis between said first and second rupture endpoints defines an opening area of said cover region;

a tab coupled to said cover region so as to permit said tab to be moved about a pivot point to press against an initial contact region of said opening area, the pivot point and initial contact region generally lying along an opening axis, with a second axis passing through said pivot point and perpendicular to said opening axis;

a reinforcing region, wherein at least a portion of a first side of said reinforcing region is substantially parallel to said gate axis, and wherein said reinforcing region lies entirely on one side of said gate axis and does not extend across said gate axis; and wherein at least part of an edge of a vent region is aligned with said gate axis, at least a portion of said vent region extending rearwardly to provide venting of a headspace of said container when said container is tipped for pouring.

2. A ventable end, as claimed in claim 1, wherein said reinforcing region and said pivot point are on the same side of said gate axis.

3. A ventable end, as claimed in claim 1, wherein said vent region is sufficiently large to provide a standard pour rate, using said opening area, of at least about 40 ml per second.

4. A ventable end, as claimed in claim 1, wherein, said container end is capable of maintaining integrity when contents of said container are pressurized to at least about 35 psi.

5. A container comprising:

a container body;

a container end, coupled to said container body, having a generally flat cover region with a score defining first and second rupture endpoints, wherein at least a portion of said score extending between said first and second rupture endpoints, together with a gate axis between said first and second rupture endpoints defines an opening area of said cover region spaced from a pivot point for coupling an opening tab;

a substantially triangular shaped reinforcing region, wherein at least a portion of an edge of said substantially triangular shaped reinforcing region is substantially adjacent said gate axis, and wherein said substantially triangular shaped reinforcing region lies entirely on one side of said gate axis and does not extend across said gate axis;

wherein said first rupture endpoint is farther from said pivot point than said second rupture endpoint and is positioned along an edge of a vent region, at least a portion of said vent region extending rearwardly to provide venting of a headspace of said container when said container is tipped for pouring;

wherein said opening area is greater than 0.451 square inches and less than about 0.5 square inches.

6. A container, as claimed in claim 5, wherein, said container end, when coupled to a container, provides a vent region sufficiently large to provide a standard pour rate, using said opening area, of at least about 40 ml per second.

7. A container, as claimed in claim 5, wherein said container end, when coupled to a container, is capable of retaining integrity when contents of said container are pressurized to at least about 35 psi.

8. A method for forming a container end comprising:

providing a generally flat cover region;

forming a score on said generally flat cover region, defining first and second rupture endpoints, wherein at least a portion of said score extending between said first and second rupture endpoints, together with a gate axis between said first and second rupture endpoints, defines an opening area of said cover region;

coupling a tab to said cover region so as to permit said tab to be moved about a pivot point to press against an initial contact region of said opening area, the pivot point and initial contact region generally lying along an opening axis, with a second axis passing through said pivot point and perpendicular to said opening axis;

forming a reinforcing region, wherein said reinforcing region has a first edge substantially parallel to said gate axis, and wherein said reinforcing region lies entirely on one side of said gate axis and does not extend across said gate axis;

wherein said gate axis defines at least a portion of an edge of a vent region, at least a portion of said vent region extending rearwardly to provide venting of a headspace of said container when said container is tipped for pouring.

9. A method for forming a container comprising:

providing a generally flat cover region;

forming a score on said generally flat cover region defining first and second rupture endpoints, wherein at least a portion of said score extending between said first and second rupture endpoints, together with a gate axis between said first and second rupture endpoints, define an opening area of said cover region spaced from a pivot point for coupling an opening tab, wherein said opening area is greater than 0.451 square inches and less than about 0.5 square inches;

forming a substantially triangular shaped reinforcing region which has a first side substantially adjacent said gate axis, and wherein said reinforcing region lies entirely on one side of said gate axis and does not extend across said gate axis;

wherein said first rupture endpoint is farther from said pivot point than said second rupture endpoint and defines an apex of a generally triangular vent region; and coupling said cover region to an open end of a container body.

10. A container comprising:

a container body;

a container end, coupled to said container body, with a pivot point for coupling an opening tab;

said container end having a generally flat cover region with a score defining first and second rupture endpoints, with a gate, lying along a gate axis, between said first and second rupture endpoints and a substantially triangular shaped reinforcing region positioned at least partially therebetween;

wherein at least a portion of said score extending between said first and second rupture endpoints, together with said gate defines an opening area of said cover region;

wherein said second rupture endpoint is positioned along an edge of a vent region, at least a portion of said vent region extending rearwardly to provide venting of a headspace of said container when said container is tipped for pouring;

wherein said gate has a length of at least about 0.25 cm.

11. A container end comprising:

a generally flat cover region with a score defining first and second rupture endpoints, wherein at least a portion of said score extending between said first and second rupture endpoints, together with a gate axis between said first and second rupture endpoints defines an opening area of said cover region spaced from a pivot point for coupling an opening tab;

a substantially triangular shaped reinforcing region, wherein said reinforcing region has a portion substantially adjacent said gate axis without extending across said gate axis;

wherein said second rupture endpoint is positioned on an edge of a vent region, at least a portion of said vent region extending rearwardly to provide venting of a headspace of said container when said container is tipped for pouring;

wherein said opening area is greater than 0.451 square inches and less than about 0.5 square inches.

* * * * *